US010927482B2

(12) United States Patent
Tanaka et al.

(10) Patent No.: US 10,927,482 B2
(45) Date of Patent: Feb. 23, 2021

(54) YARN, FABRIC, AND FIBER PRODUCT

(71) Applicant: TEIJIN FRONTIER CO., LTD., Osaka (JP)

(72) Inventors: Kengo Tanaka, Osaka (JP); Akira Tanaka, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 200 days.

(21) Appl. No.: 16/079,608

(22) PCT Filed: Apr. 7, 2017

(86) PCT No.: PCT/JP2017/014479
§ 371 (c)(1),
(2) Date: Aug. 24, 2018

(87) PCT Pub. No.: WO2017/183485
PCT Pub. Date: Oct. 26, 2017

(65) Prior Publication Data

US 2019/0055674 A1 Feb. 21, 2019

(30) Foreign Application Priority Data

Apr. 20, 2016 (JP) ..... JP2016-084547
Oct. 26, 2016 (JP) ..... JP2016-209584

(51) Int. Cl.
*D02G 3/04* (2006.01)
*D06M 15/333* (2006.01)

(52) U.S. Cl.
CPC ..... *D02G 3/04* (2013.01); *D06M 15/333* (2013.01); *D10B 2331/04* (2013.01)

(58) Field of Classification Search
CPC ..... D02G 3/04; D02G 3/045; D02G 3/28; D02G 3/40; D02G 3/402; D02G 3/404; D06M 15/333; D10B 2331/04
See application file for complete search history.

(56) References Cited

U.S. PATENT DOCUMENTS 4,137,615 A * 2/1979 Webster ..... D02G 1/002 28/154
5,633,075 A * 5/1997 Park ..... B29B 15/105 442/187
2003/0096547 A1* 5/2003 Oka ..... D03D 15/08 442/184
2004/0065072 A1* 4/2004 Zhu ..... D02G 3/28 57/314
2007/0271681 A1* 11/2007 Heisler ..... A41B 11/008 2/239
2011/0072776 A1* 3/2011 De Greve ..... D02G 3/441 57/211
2012/0288703 A1 11/2012 Masuda et al.
2013/0323456 A1* 12/2013 Seo ..... D01F 6/92 428/97
2014/0075646 A1* 3/2014 Henssen ..... D02G 3/442 2/167
2014/0331893 A1* 11/2014 Salmela ..... B29C 48/05 106/162.1
2015/0020546 A1* 1/2015 Zhang ..... D04B 21/18 66/202
2018/0371653 A1* 12/2018 Ogata ..... A41D 31/00

FOREIGN PATENT DOCUMENTS

| | | | |
|---|---|---|---|
| CN | 102912502 | A | 2/2013 |
| JP | 58-7721 | B2 | 2/1983 |
| JP | 2005-023466 | A | 1/2005 |
| JP | 2005194661 | A | 7/2005 |
| JP | 2006-249623 | A | 9/2006 |
| JP | 2009-007705 | A | 1/2009 |
| JP | 2010-024570 | A | 2/2010 |
| JP | 2011-047068 | A | 3/2011 |
| JP | 2011-117099 | A | 6/2011 |
| JP | 2012-193476 | A | 10/2012 |
| JP | 2014-210986 | A | 11/2014 |
| TW | 201144497 | A1 | 12/2011 |
| WO | 2005/095686 | A1 | 10/2005 |

OTHER PUBLICATIONS

Machine Translation JP2014210986, obtained May 5, 2020.*
International Search Report for PCT/JP2017/014479 dated Jun. 20, 2017 [PCT/ISA/210].

* cited by examiner

*Primary Examiner* — Shaun R Hurley
(74) *Attorney, Agent, or Firm* — Sughrue Mion, PLLC

(57) ABSTRACT

The problem addressed by the present invention is to provide yarn, which includes an ultrafine filament, and that has superior handling properties, elongation and contraction properties, and with which a fabric and a fiber product of high quality can be obtained, a fabric using this yarn, and a fiber product using this yarn or fabric. The solution is imparting a binder to yarn that includes a filament A-1 with a single fiber diameter of 10 to 3000 nm and a fiber A-2 with a single fiber diameter greater than the filament A-1, and obtaining a fabric or fiber product using the yarn as necessary.

15 Claims, No Drawings

YARN, FABRIC, AND FIBER PRODUCT

CROSS REFERENCE TO RELATED APPLICATIONS

This application is a National Stage of International Application No. PCT/JP2017/014479, filed on Apr. 7, 2017, which claims priority from Japanese Patent Application No. 2016-084547, filed on Apr. 20, 2016, and Japanese Patent Application No. 2016-209584, filed on Oct. 26, 2016.

TECHNICAL FIELD

The present invention relates to a yarn including an ultrafine filament, which has excellent handleability and elasticity and from which high-quality fabrics and fiber products can be obtained, and a fabric made of the yarn, and fiber products made from the yarn or the fabric.

BACKGROUND ART

Fabrics using ultrafine filaments in order to achieve excellent anti-slip performance, wiping performance, and a soft texture have been proposed (for example, Patent Literature 1).

However, in such fabrics, after obtaining a fabric using a sea-island type composite fiber, the sea component of the sea-island type composite fiber is dissolved and removed with an alkali. Thus, there are restrictions on the equipment and there is a problem in that the processing becomes complicated. Further, there is a problem in that it is difficult to interweave and interlace such a fiber with another fiber which is weak in alkali resistance, such as wool.

Furthermore, Patent Literature 2 also proposes an ultrafine filament. However, when a fabric or fiber product using such an ultrafine filament is produced, since the surface of the filament is scratched by the production equipment and yarn breakage occurs, there is a problem in that processing stability is poor and a high-quality fabric or fiber product cannot be obtained.

Patent Literature 3 proposes a yarn which is excellent in handleability and from which a high-quality fabric or fiber product can be obtained by imparting a binder to a yarn including an ultrafine filament. However, there are problems with the knitting of such yarn and there is still room for improvement in the stable production of a fabric or fiber product therewith.

Various socks such as socks having improved water absorbency due to the use of an ultrafine fiber and socks provided with a plate-like object in the sole have been proposed (for example, Patent Literature 4 and Patent Literature 5).

However, socks in which a plate-like object is not provided, in which slippage between a shoe and the socks is prevented due to the effect of the fiber, and which have improved comfort have not been proposed.

CITATION LIST

Patent Literature

[Patent Literature 1] WO 05/095686
[Patent Literature 2] Japanese Unexamined Patent Publication (Kokai) No. 2012-193476
[Patent Literature 3] Japanese Unexamined Patent Publication (Kokai) No. 2014-210986

[Patent Literature 4] Japanese Examined Patent Publication (Kokoku) No. 58-7721
[Patent Literature 5] Japanese Unexamined Patent Publication (Kokai) No. 2006-249623

SUMMARY

Technical Problem

The present invention has been made in view of the background above and aims to provide a yarn including an ultrafine filament, which has excellent handleability and elasticity and from which a high-quality fabric or fiber product can be obtained, a fabric made using the yarn, and a fiber product made using the yarn or the fabric.

Solution to Problem

As a result of rigorous experimentation in order to achieve the object described above, the present inventors have discovered that a yarn which has superior handling properties and elongation and contraction properties, and with which a high-quality fabric and fiber product can be obtained, can be obtained by imparting a binder to a yarn that includes an ultrafine filament and a fiber having a fiber diameter greater than the filament.

According to the present invention, a "yarn comprising a filament A-1 having a single fiber diameter of 10 to 3000 nm and a fiber A-2 having a single fiber diameter greater than the filament A-1, wherein a binder is imparted to the yarn" is provided.

It is preferable that the binder comprise a sizing agent and/or an oiling agent. It is preferable that the application amount of the binder be 0.1 to 15 wt % with respect to the weight of the yarn. It is preferable that the number of filaments of the filament A-1 included in the yarn be not less than 500. It is preferable that the filament A-1 be obtained from a sea-island type composite fiber composed of a sea component and an island component by dissolving and removing the sea component. It is preferable that, after combining a sea-island type composite fiber composed of a sea component and an island component with the fiber A-2, the filament A-1 be obtained by dissolving and removing the sea component of the sea-island type composite fiber. It is preferable that the filament A-1 be made of polyester fibers. It is preferable that the fiber A-2 be a crimped fiber having a single-fiber diameter of not less than 5 μm and an apparent crimp rate of not less than 2%. It is preferable that the crimped fiber be a composite fiber in which two components are laminated in a side-by-side manner or in an eccentric core-sheath manner, or a false twist crimped processed yarn. It is preferable that the total fineness of the yarn be in the range of 50 to 1400 dtex. It is preferable that the yarn be dyed.

Furthermore, according to the present invention, a fabric obtained using the yarn is provided. It is preferable that the yarn further comprise a yarn B including an elastic fiber. It is preferable that the weight ratio (A-1+A-2):B of the total weight of filament A-1 and the fiber A-2 to the yarn B be in the range from 95:5 to 30:70. It is preferable that the coefficient of friction of a front surface or back surface of the fabric be in the range of 0.4 to 2.5.

Furthermore, according to the present invention, a fiber product selected from the group consisting of socks, gloves, supporters, clothing, textile tape, and string obtained using the yarn or the fabric is provided.

Advantageous Effects of Invention

According to the present invention, a yarn which includes an ultrafine filament and with which a high-quality fabric or fiber product can be obtained, a fabric made using the yarn, and a fiber product made using the yarn or the fabric can be obtained.

DESCRIPTION OF EMBODIMENTS

Embodiments of the present invention will be described in detail below. The yarn of the present invention (hereinafter sometimes referred to as "yarn A") includes a filament having a single-fiber diameter of 10 to 3000 nm and a fiber A-2 having a single-fiber diameter greater than the filament A-1.

It is critical that the filament A-1 (hereinafter sometimes referred to as a "nanofiber") have a single fiber diameter (the diameter of a single fiber) in the range of 10 to 3000 nm (preferably 250 to 1500 nm, particularly preferably 400 to 800 nm). When the single-fiber diameter is smaller than 10 nm the strength of the fiber is reduced, which is not preferable. Conversely, when the single-fiber diameter is greater than 3000 nm, non-slip performance, wiping performance, a soft texture, etc., may not be obtained, which is not preferable. When the cross-sectional shape of the single fiber has an atypical cross-section other than a round cross-section, the single fiber diameter is the diameter of a circle circumscribed on the cross-section. The single-fiber diameter can be measured by photographing the cross-section of the fiber with a transmission electron microscope.

The number of filaments in the filament A-1 is not particularly limited and is preferably 500 or more (more preferably 2000 to 60000) so as to obtain anti-slip performance, wiping performance, a soft texture, etc.

The fiber form of the filament A-1 is not particularly limited and may be a spun yarn or may be long fibers (multi-filament yarn). Long fibers (multi-filament yarn) are particularly preferable. The single-fiber cross-sectional shape is not particularly limited and may be any well-known cross-sectional shape, such as round, triangular, flat, or hollow. Furthermore, an air treatment such as an interlacing treatment, Taslan (registered trademark) processing, or a false twist crimping treatment may be applied.

As the fiber type of the filament A-1, polyester fibers, polyphenylene sulfide (PPS) fibers, polyolefin fibers, or nylon (Ny) fibers are preferable.

The polyester forming the polyester fibers is preferably polyethylene terephthalate (PET), polytrimethylene terephthalate, polybutylene terephthalate, polyethylene naphthalate or a copolymer composed thereof as the main repeating unit and composed of an aromatic dicarboxylic acid such as isophthalic acid and 5-sulfoisophthalic acid metal salt, an aliphatic dicarboxylic acid such as adipic acid or sebacic acid, or a hydroxycarboxylic acid condensate such as ε-caprolactone, with a glycol component such as diethylene glycol, trimethylene glycol, tetramethylene glycol, or hexamethylene glycol. Materially recycled or chemically recycled polyester or a polyethylene terephthalate obtained using a biomass, i.e., a biological substance, as a raw material, as described in Japanese Unexamined Patent Publication (Kokai) No. 2009-091694, may be used. Further, a polyester obtained using a catalyst containing a specific phosphorus compound and a specific titanium compound, as described in Japanese Unexamined Patent Publication (Kokai) No. 2004-270097 or Japanese Unexamined Patent Publication (Kokai) No. 2004-211268, may be used.

As the polyarylene sulfide resin forming the polyphenylene sulfide (PPS) fiber, any polyarylene sulfide resin may be used as long as it falls within the category referred to as "polyarylene sulfide resins". As for the polyarylene sulfide resin, for example, p-phenylene sulfide units, m-phenylene sulfide units, o-phenylene sulfide units, phenylene sulfide sulfone units, phenylene sulfide ketone units, phenylene sulfide ether units, diphenylene sulfide units, substituent-containing phenylene sulfide units, or branched structure-containing phenylene sulfide units may be used as constituent units thereof. Among these, 70 mol % or more, particularly 90 mol % or more, of p-phenylene sulfide units are preferably contained, and poly(p-phenylene sulfide) is more preferable.

Furthermore, the polyolefin fibers may include polypropylene fibers and polyethylene fibers.

Furthermore, the nylon fibers may include nylon 6 fibers and nylon 66 fibers.

If necessary, a micropore forming agent, a cationic dyeing agent, a color inhibitor, a heat stabilizer, a fluorescent whitening agent, a matting agent, a coloring agent, a moisture absorbent, or inorganic fine particles may be contained alone or in a combination of two or more in the polymer forming the filament A-1, as long as the object of the present invention is not impaired.

The method for producing the filament A-1 is not particularly limited and may be a method for dissolving and removing the sea component of a sea-island type composite fiber composed of a sea component and an island component, an electro-spinning method, a conventional spinning and stretching method, or the like.

Next, the fiber form of the fiber A-2 is not particularly limited and may be a spun yarn or may be long fibers (multi-filament yarn). Long fibers (multi-filament yarn) are particularly preferably to obtain excellent elasticity. The single-fiber cross-sectional shape is not particularly limited and may be any well-known cross-sectional shape, such as round, triangular, flat, or hollow. Furthermore, a common air treatment or false twist crimping treatment may be performed.

As the fiber type of the fiber A-2, polyester fibers, polyethylene sulfide (PPS) fibers, polyolefin fibers, nylon (Ny) fibers, cotton, acrylic fibers, rayon, acetate fibers or the like may be used.

The total fineness and single-fiber fineness of the fiber A-2 can be appropriately selected in accordance with need and the total fineness is preferably in the range of 20 to 200 dtex and the single-fiber fineness is preferably in the range of 0.5 to 10.0 dtex. The number of filaments is preferably in the range of 1 to 300. The single-fiber diameter is preferably in the range of 5 to 20 μm. When the single-fiber diameter is less than 5 μm, there is a risk that the shape retention property of the yarn may be impaired. Conversely, when the single-fiber diameter is greater than 20 μm, there is a risk that a soft texture may not be obtained. When the single-fiber cross-sectional shape is an atypical cross-section other than a round cross-section, the single-fiber diameter is set to the diameter of a circle circumscribed onto the cross-section. The single-fiber diameter can be measured by photographing the cross-section of the fiber with a transmission electron microscope, as described above.

Furthermore, the fiber A-2 is preferably a crimped fiber. A crimped fiber having single-fiber diameter of 5 μm or more (more preferably 5 to 20 μm) and an apparent crimp rate of 2% or more (more preferably 2 to 40%) is preferable. As such a crimped fiber, a composite fiber in which two components are bonded together in a side-by-side manner or an eccentric core-sheath manner, or a false twist crimped processed yarn is preferable.

The composite fiber is a composite fiber in which two components are boned together in a side-by-side or an eccentric core-sheath manner. When the yarn of the present invention includes not just the filament A-1 but also such a composite fiber, in the heat treatment process, the composite fiber takes the form of a three-dimensionally coiled crimp, whereby elasticity is imparted to the yarn, and as a result, elasticity is imparted to a fabric.

As the two components forming the composite fiber, a combination of polyester and polyester, a combination of polyester and nylon, or the like may be used. More specifically, a combination of polytrimethylene terephthalate and polytrimethylene terephthalate, a combination of polytrimethylene terephthalate and polyethylene terephthalate, a combination of polyethylene terephthalate and polyethylene terephthalate, or the like is preferable. It is preferable that the intrinsic viscosities thereof be different from each other. Furthermore, an additive such as an antioxidant, an ultraviolet absorber, a heat stabilizer, a flame retardant, titanium oxide, a coloring agent, or inert fine particles may be included.

The polyester may be a materially recycled or chemically recycled polyester. Further, a polyester or polylactic acid obtained by using a catalyst containing a specific phosphorus compound and a specific titanium compound, as described in Japanese Unexamined Patent Publication (Kokai) No. 2004-270097 or Japanese Unexamined Patent Publication (Kokai) No. 2004-211268, or a stereocomplex polylactic acid may be used. If a further anti-slip effect is desired, an elastic resin such as polyether ester or polyurethane is preferable. The polymer may contain, if necessary, one or two or more of a micropore forming agent, cationic dyeing agent, discoloration prevention agent, heat stabilizer, fluorescent whitening agent, matting agent, coloring agent, moisture absorbent, and inorganic fine particle, in quantities which do not impair the object of the present application.

The yarn of the present application includes the filament A-1 and the fiber A-2. The weight ratio of the fiber A-2 included in the yarn is preferably in the range from 2 to 40 wt % (more preferably 4 to 30 wt %, and particularly preferably 4 to 20 wt %) in order to achieve characteristics and elasticity compatible with the filament A-1.

The method for combining the filament A-1 and the fiber A-2 in the yarn of the present invention is not particularly limited and may be a composite false twisting method, an air mixing method, a twisting method, or a covering method.

A fiber other than the filament A-1 and the fiber A-2 such as, for example, a polyurethane fiber or a polyether ester fiber, may be further included in the yarn of the present invention.

The total fineness of the yarn (the product of the single-fiber fineness and the number of filaments) is preferably in the range of 50 to 1400 dtex (more preferably 65 to 800 dtex, and particularly preferably 65 to 400 dtex). When the total fineness is less than 50 dtex, the strength of the yarn may be reduced. Conversely, when the total fineness is greater than 1400 dtex, when producing a fiber product using the yarn, it may be difficult to load the yarn into the production equipment.

The yarn of the present invention is preferably dyed since it is not necessary to subject the fabric or fiber product to a dyeing process after a fabric or fiber product produced using the yarn is obtained. The brightness index of the yarn after dyeing is preferably in the range of 10 to 90.

A binder is imparted to the yarn of the present invention. Any binder can be used so long as it has convergence properties such that it can visually be confirmed that single yarns are agglomerated in a free yarn state (non-tensioned state). When a binder is not imparted, the handling properties of the yarn are reduced, and a high-quality fabric or fiber product may not be obtained, which is not preferable.

In order to obtain excellent convergence properties, the binder preferably includes at least one of a sizing agent and an oiling agent. The binder may be composed of only one of the sizing agent and the oiling agent or may be composed of both.

As the sizing agent, PVA (polyvinyl alcohol) or an acrylic-based sizing agent such as a polyacrylic acid ester, a polyacrylic acid, a polymethacrylic acid ester, a polymethacrylic acid, or a polyacrylic acid soda may be used.

Furthermore, a wax or surfactant may be included in the binder. Such waxes include natural waxes such as carnauba wax, candelilla wax, and Montan wax, and synthetic waxes such as polyethylene wax.

The oiling agent may be, for example, the oiling agent described in Japanese Unexamined Patent Publication (Kokai) No. 10-158939 or a lubricating oil (mineral oil). Commercially available so-called "corning oils" such as "LAN-401" (product name) produced by Nicca Chemical Co., Ltd., or "Brian C-1840-1" (product name) produced by Matsumoto Yushi-Seiyaku Co., Ltd are preferably used.

The amount of solid content of the binder imparted to the yarn of the present invention is preferably in the range of 0.1 to 15 wt % (more preferably 0.1 to 10 wt %) based on the weight of the yarn. When a sizing agent is not imparted to the surface of the yarn or the amount imparted is less than 0.1 wt %, since the yarn includes the ultrafine filament, nap, etc., may occur when a fabric or fiber product is manufactured using the yarn, which may cause quality problems. Further, when the amount imparted is greater than 15 wt %, the yarn becomes rigid and it is difficult to produce a fabric or fiber product using such a yarn.

The yarn of the present invention can be produced by, for example, the following production method. First, a sea-island-type composite fiber formed from a sea component and an island component is used (the fiber used in filament A-1). As the sea-island-type composite fiber, the sea-island-type composite fiber multi-filament (number of islands: 100 to 1500) disclosed in Japanese Unexamined Patent Publication (Kokai) No. 2007-2364 is preferably used.

Polyester, polyamide, polystyrene, polyethylene, etc., having good fiber forming properties are preferably used as the sea component polymer. For example, as the alkaline aqueous solution readily-soluble polymer, polylactic acid, an ultrahigh molecular weight polyalkylene oxide condensation polymer, a polyethylene glycol compound copolymerized polyester, or a copolyester of a polyethylene glycol compound and 5-sodium sulfonic acid isophthalic acid is preferable. From thereamong, a polyethylene terephthalate-type copolyester having an intrinsic viscosity of 0.4 to 0.6 obtained by copolymerizing 6 to 12 mol % of 5-sodium sulfoisophthalic acid and 3 to 10 wt % of polyethylene glycol having a molecular weight of 4000 to 12000 is preferable.

As the polymer of the island component, a polyester such as a fiber-forming polyethylene terephthalate, polytrimethylene terephthalate, polybutylene terephthalate, polylactic acid, or a polyester copolymerized with a third component is preferred. One or more of a micropore-forming agent, a cationic dyeing agent, a discoloration preventing agent, a heat stabilizer, a fluorescent whitening agent, a matting agent, a coloring agent, a moisture absorbent, and inorganic fine particles may be contained in the polymer, if necessary, in an amount so as not to impair the object of the present invention.

In the sea-island type composite fiber composed of the above-described sea component polymer and island component polymer, during melt spinning, the melt viscosity of the sea component is preferably greater than the melt viscosity of the island component polymer. Furthermore, it is necessary that the diameter of the island component be in the range of 10 to 3000 nm. At that time, if the shape of the island component is not a perfect circle, the diameter is determined as the diameter of a circle circumscribed on the cross-section thereof. The sea-island composite weight ratio (sea:island) of the sea-island type composite fiber is preferably in the range of 40:60 to 5:95, particularly preferably in the range of 30:70 to 10:90.

Such a sea-island type composite fiber can be easily produced by, for example, the following method. Melt spinning is carried out using the above sea component polymer and island component polymer. As the spinneret used for melt spinning, any such as a spinneret having a hollow pin group or fine hole group for forming an island component can be used. The extruded sea island-type composite fiber is solidified by air cooling and is preferably melt-spun at 400 to 6000 m/min, and then wound. The undrawn yarn thus obtained may be made into a composite fiber (drawn yarn) having desired strength, elongation and heat shrinkage characteristics through a separate stretching step, or alternatively, a method in which the undrawn yarn is pulled onto a roller at a constant speed without winding, and wound after the drawing process has been performed may be used. In such sea-island type composite fiber, the single-fiber fineness, the number of filaments, and the total fineness are within the ranges of a single-fiber fineness of 0.5 to 10.0 dtex, the number of filaments of 5 to 75, and a total fineness of 30 to 170 dtex.

Next, a yarn is produced using the sea-island type composite fiber, fiber A-2, and optionally other fibers (A-3, A-4, . . . ). To ensure that the sea-island type composite fiber is exposed to the surface of the yarn, a method of arranging the sea-island type composite fiber in the outermost layer and arranging the other fibers in the middle layer as the three-layer structure of the yarn or producing the yarn by arranging the sea-island type composite fiber in the sheath part and arranging the fiber A-2 in the core part is preferable. At that time, the machine to be used is not limited, and a conventionally known air mixing fiber processing machine, false twist crimping machine or covering machine may be used. Furthermore, when making the obtained combine yarn into a fiber product such as a woven or knitted fabric, a twisting of 500 twists/m or less may be further applied.

Next, the yarn is treated with an alkaline aqueous solution. By dissolving and removing the sea component of the sea-island type composite fiber with the alkaline aqueous solution, the filament A-1 having a single-fiber diameter of 10 to 3000 nm is formed from the sea-island type composite fiber. As the conditions for treatment with the alkaline aqueous solution, it is preferable to treat at a temperature of 55 to 98° C. using an NaOH aqueous solution having a concentration of 1 to 4%.

Furthermore, the yarn may be subjected to a dyeing process before and/or after dissolution and removal with the alkali aqueous solution. Further, conventional brush treatment, water repellant treatment, and ultraviolet shielding may be performed, and various agents for imparting properties such as an antistatic agent, antibacterial agent, deodorant, insect repellent, phosphorescent agent, retroreflective agent, or negative ion generating agent may be additionally applied.

After the sea component of the sea-island type composite fiber is dissolved and removed with the alkaline aqueous solution and a yarn comprising a filament A-1 having a single-fiber diameter of 10 to 3000 nm and a fiber A-2 is obtained, the binder is imparted to the yarn and dried if necessary, whereby the yarn of the present invention is obtained. The processing machine to be used is not limited and any conventionally known sizing machine may be used.

The process for dissolving and removing the sea component of the sea-island type composite fiber with an alkaline aqueous solution may be performed before combining the sea-island type composite fiber and the fiber A-2 or may be performed after combining the sea-island type composite fiber and the fiber A-2.

The yarn thus obtained includes an ultrafine filament and is excellent in handleability and elasticity. A high-quality fabric or fiber product can be obtained with this yarn.

Next, the fabric of the present invention is a fabric obtained by weaving, knitting, or braiding the yarn. Such fabric may be composed of only the yarn (yarn A) or may be composed of the yarn (yarn A) and a different yarn. A yarn (yarn B) comprising elastic fibers is preferably used as the different yarn. The yarn (yarn A) and yarn B may be combined and included in a fabric as a composite yarn, or the yarn (yarn A) and yarn B may be combined or interlaced to be included in the fabric.

The yarn B may be composed of only elastic fibers or may be composed of elastic fibers and non-elastic fibers.

For example, a core-sheath type composite yarn in which an elastic fiber is disposed in a core part and a non-elastic fiber is disposed in a sheath part may be used. A core-sheath type composite yarn, also known as an FTY (Filament Twisted Yarn), in which, for example, an elastic fiber such as a polyamide fiber, a polyurethane fiber, or a polyester fiber is arranged in a core part and covered with a sheath part such as a polyester fiber or a nylon fiber is preferable. When elastic fibers are not included in the fabric, the elasticity of the fabric is reduced and the comfort of the fabric obtained therewith as socks may be reduced. Furthermore, cotton may be used as yarn B to prevent the accumulation of moisture in shoes.

The total fineness of yarn B is preferably in the range of 10 to 800 dtex (more preferably 20 to 500 dtex). When the total fineness is less than 10 dtex, sufficient elasticity cannot be obtained and there is a risk that comfortable socks cannot be obtained therewith. Furthermore, when the total fineness exceeds 800 dtex, elasticity becomes excessive and there is a risk that shape retention as a fabric cannot be obtained.

In the present invention, the weight ratio (A-1+A-2):B of the total weight of the filament A-1 and the fiber A-2 (the weight of the yarn A) to the yarn B is preferably in the range from 30:70 to 95:5. When the proportion of (A-1+A-2) is smaller than this range, there is a risk that a sufficient anti-slip effect cannot be obtained. Conversely, when the proportion of yarn B is smaller than this range, since the woven or knitted fabric has insufficient elasticity, the comfort of socks obtained using the fabric may be reduced.

The yarn A is preferably exposed on both the front surface and the back surface of the fabric. By exposing the yarn A (the filament A-1) to the skin, excellent frictional force with the skin can be obtained, whereby the socks do not slip and wearing comfort improves. Furthermore, by exposing the yarn A (the filament A-1) outwardly, excellent frictional force with the shoes can be obtained, whereby the socks do no and wearing comfort improves.

The textile weave and textile knit of the fabric are not particularly limited. Examples of weft knitting structure include a plain stitch, rib stitch, double-sided stitch, pearl stitch, tuck stitch, floating stitch, half-cardigan stitch, lace stitch, split-hair stitch or the like. As the warp stitch structure, a single denby stitch, single atlas stitch, double cord stitch, half stitch, half base stitch, satin stitch, half tricot stitch, fleece stitch, jacquard stitch or the like may be used. As the textile weave, a three-foundation weave such as a plain weave, a twill weave, a sateen weave, a derivative weave, a single-duplex structure such as a warp double-weave or a weft double-weave, or a velvet weave may be used. However, the fabric is not limited thereto. The layer thereof may be a single layer or a multilayer of two or more layers.

Furthermore, the coefficient of friction of the front surface or back surface of the fabric is preferably 0.4 to 2.5 (more preferably 0.5 to 2.3). When the coefficient of friction is less than 0.4, there is a risk that sufficient slip prevention cannot be obtained. Furthermore, when the coefficient of friction exceeds 2.5, since the frictional resistance becomes excessive, it is difficult to put on or remove shoes. Note that the coefficient of friction is a static coefficient of friction measured in accordance with the method of ASTM D1894-95.

Such fabric is subjected to soaping (scouring) to remove the binder adhering to the yarn A, whereby excellent anti-slip performance, wiping performance, a soft texture and the like is obtained. Furthermore, since the fabric is produced using the above-mentioned yarn, it is excellent in processability and high in quality.

Next, the fiber product of the present invention is obtained using the yarn A or the fabric and is selected from the group consisting of socks, gloves, supporters, clothing, textile tape, and string.

Furthermore, in socks, it is preferable that the yarn A be arranged in part of or all of the heel, sole, toe, etc., of the sock. The form of such socks is not particularly limited, and the socks may be men's socks, women's socks, children's socks, socks to be worn with high-heels, also known as foot covers, stockings, etc.

Such fiber product is subjected to soaping (scouring) to remove the binder adhering to the yarn, whereby excellent anti-slip performance, wiping performance, soft texture and the like is obtained. Furthermore, since the fiber product is produced using the above-mentioned yarn, it is excellent in processability and high in quality.

EXAMPLES

Next, the Examples and Comparative Examples of the present invention will be described. The present invention is not limited to these Examples and Comparative Examples. Note that, in the Examples, the measurements were taken in accordance with the following methods.

<Melt Viscosity>

After the drying treatment, the polymer is loaded into the orifice set an extruder melting temperature for spinning. After melting and holding therein for five minutes, the polymer is extruded with loads of several levels and the shear rates and melt viscosities are plotted. The plots are smoothly connected to form a shear rate-melt viscosity curve and the melt viscosity at a shear rate of 1000 $sec^{-1}$ is measured.

<Dissolution Rate>

A multi-filament having a total fineness of 84 dtex/24 fil was produced by spinning a yarn from the sea and island components at a spinning speed of 1000 to 2000 m/min with an extrusion die at 0.3φ−0.6 L×24 H. Further, the multi-filament was stretched so that the residual elongation was in the range of 30 to 60%. The rate of weight reduction was calculated from the dissolution time and dissolution amount at a bath ratio of 100 at a temperature sufficient for dissolution in each solvent.

<Single-Fiber Diameter>

After photographing the fabric with an electron microscope, the single fiber diameter of five fibers is measured and the average value is determined.

<Apparent Crimp Rate>

The crimped fiber A-2 only is removed from the yarn and the length (L0) under a load of 0.222 gr/dtex and the length (L1) after an elapsed time of one minute under a load of 2 mg/dtex are measured, and the apparent crimp rate is calculated using the following formula.

$$\text{Apparent Crimp Rate (\%)}=[(L0-L1)/L0]\times 100$$

<Binder Application Amount>

Approximately 2 gr of yarn is wound on a Hank winder, frilly dried at 105° C. for 2 hours, allowed to cool for 2 hours in a desiccator containing silica gel, and the weight (W1) is measured. Thereafter, the yarn is treated for 1 hour at 98° C. in an aqueous solution to which 4 gr/L of soda ash, 2 gr/L of a surfactant, and 2 gr/L of sodium tripolyphosphate were added. The treated yarn is fully dried at 105° C. for 2 hours, allowed to cool for 2 hours in a desiccator containing silica gel, and the weight (W2) is measured. The binder application amount is calculated by the following Formula.

$$\text{Binder Application Amount (\%)}=(W1-W2)/W1\times 100$$

<Yarn Handleability>

The processability of the yarn when knitting a round knitted fabric is evaluated as "excellent", "average", or "inferior; nap was generated".

<Coefficient of Friction>

The static coefficient of friction is measured in accordance with the method of ASTM D1894-95. This static coefficient of friction is taken as the coefficient of friction.

Example 1

A sea-island type composite undrawn fiber having a sea:island ratio of 30:70 and the number of islands=836 was melt-spun using polyethylene terephthalate (melt viscosity at 280° C.=1200 poise, matting agent content: 0 wt %) as the island component and polyethylene terephthalate (melt viscosity at 280=1750 poise) obtained by copolymerizing 6 mol % of 5-sodium sulfoisophthalic acid and 6 wt % of polyethylene glycol having a number average molecular weight of 4000 as the sea component (dissolution rate ratio (sea/island)=230) and wound one time.

The obtained undrawn fiber was subjected to roller stretching at a stretching temperature of 80° C. and a stretching magnification of 2.5 times, then thermally set at 150° C. and wound. The obtained sea-island type composite fiber (fiber used as filament A-1; drawn yarn) had a total fineness of 56 dtex/10 fil. Observation of the cross-section of the fiber by transmission electron microscopy TEM revealed that the shapes of the islands were round and the diameters of the islands were 700 nm.

Two of the obtained sea-island type composite fibers and one side-by-side composite fiber multi-filament (total fineness 56 dtex/36 fil; single fiber diameter 12 μm, fiber A-2), in which the single fiber was composed of polytrimethylene terephthalate as one component and polyethylene terephthalate as the other component were aligned and interlaced to obtain a mixed-filament yarn.

Next, in order to remove the sea component of the sea-island type composite fiber included in the yarn, the yarn was reduced by 20% (alkaline reduction) with a 2.0% NaOH aqueous solution at 70° C. Thereafter, the fiber was dyed gray by a conventional dying process.

Thereafter, an aqueous solution containing 5% sol of PVA (molecular weight: 500) and 1% sol of polyacrylic acid ester as a binder (sizing agent) was prepared. While unreeling the yarn, the yarn was continuously immersed in the aqueous binder solution and wound while drying at a temperature of 80° C.

The obtained yarn was composed of the filament A-1 having a single-fiber diameter of 700 nm and the side-by-side composite fiber multi-filament (fiber A-2) having a single-fiber diameter of 12 μm and an apparent crimp rate of 5.2%, wherein the total fineness of the yarn was 157 dtex, and the application amount of the binder (sizing agent) was 7.2 wt %.

Using the obtained yarn, a round knitted fabric having a smooth texture was knit using an ordinary circular knitting machine. Since the yarn had elasticity, it was stably knitted, and yarn breakage due to nap, etc., did not occur. As a result, the yarn was excellent in handleability.

The obtained round knitted fabric was soaped with an aqueous solution containing 4% sol of soda ash and 2% sol of surfactant at 60° C. to completely remove the binder (sizing agent), whereby the filament A-1 having a single-fiber diameter of 700 man was exposed. The fiber was very non-slippery. The coefficient of friction thereof was very high, 2.2. Furthermore, knitting defects such as yarn breakage due to nap, etc., were not observed, and the quality thereof was high. Subsequently, gloves were produced using the circular knitted fabric, which were of a high grade.

Example 2

Two sea-island type composite fibers obtained in the same manner as Example 1 and one polyethylene terephthalate multi-filament (total fineness 56 dtex/48 fil; single-fiber diameter 10.5 μm, fiber A-2) were aligned and subjected to a composite false twist crimping process to obtain a composite yarn.

Next, in order to remove the sea component of the sea-island type composite fiber included in the combined yarn, the yarn was reduced by 20% (alkaline reduction) with a 2.0% NaOH aqueous solution at 70° C. Thereafter, the fiber was dyed gray by a conventional dying process.

Thereafter, an aqueous solution containing 5% sol of PVA (molecular weight: 500) and 1% sol of polyacrylic acid ester as a binder (sizing agent) was prepared. While unreeling the yarn, the yarn was continuously immersed in the aqueous binder solution and wound while drying at a temperature of 80° C.

The obtained yarn was composed of the filament A-1 having a single-fiber diameter of 700 nm and the polyester multi-filament (fiber A-2) made of a false-twist crimped processed yarn having a single-fiber diameter of 10.5 μm and an apparent crimp rate of 7.8%. The total fineness of the yarn was 162 dtex and the application amount of the binder (sizing agent) was 9.6 wt %.

As a result of soaping in the same manner as in Example 1, the binder (sizing agent) was completely removed and the filament A-1 having a single-fiber diameter of 700 nm was exposed. The yarn was very non-slippery. The coefficient of friction thereof was a very high value of 2.0. Furthermore, knitting, defects such as yarn breakage due to nap, etc., were not observed, and the yarn was of a high quality. Subsequently, gloves were produced using the circular knitted fabric, which were of a high grade.

Example 3

Example 3 was the same as Example 1, except that an oil agent ("Brian C-1840-1" (product name) produced by Matsumoto Yushi-Seiyaku Co., Ltd) was used in place of the sizing agent as the binder, and the application amount of the oil agent (binder) was 5.5 wt %. As a result of soaping, the binder was completely removed, exposing the filament A-1 having a single-fiber diameter of 700 nm. The yarn was very non-slippery. The coefficient of friction thereof was a very high value of 2.2. Furthermore, knitting defects such as yarn breakage due to nap, etc., were not observed, and the yarn was of a high quality. Subsequently, gloves were produced using the circular knitted fabric, which were of a high grade.

Comparative Example 1

A yarn imparted with a binder (sizing agent) was obtained in the same manner as in Example 1 except that a polyethylene terephthalate multi-filament having a total fineness of 56 dtex/10 fil was used in place of the sea-island type composite fiber in Example 1.

In the obtained yarn, the single-fiber diameter of the polyethylene terephthalate multi-filament was 23 μm and the single-fiber diameter of the side-by-side composite fiber multi-filament (fiber A-2) was 12 μm. Furthermore, all the fibers exposed on the surface of the yarn were polyethylene terephthalate multi-filament. The yarn was knitted and the sizing agent was removed by a soaping process. The circular knitted fabric did not have anti-slip performance. The coefficient of friction thereof was a low value of 0.3.

Comparative Example 2

A composite yarn was obtained in the same manner as Example 1, and after an alkaline weight-reduced yarn was obtained, the yarn was knit with a circular knitting machine without imparting a binder (sizing agent) to the yarn. The yarn was scratched in the guides, etc., whereby nap and significant yarn breakage occurred. The combined yarn had inferior handleability. The coefficient of friction of the yarn was a high value of 1.9, but the obtained circular knitted was of poor quality.

Example 4

Two sea-island type composite fibers obtained in the same manner as Example 1 and one polyethylene terephthalate multi-filament (total fineness 56 dtex/48 fil; single-fiber diameter 10.5 μm; fiber A-2) were aligned and subjected to a composite false twist crimping process to obtain a composite yarn. Two of the obtained composite yarn were twisted with a twisting machine at a twisting number off 120 Z twists/m.

Next, in order to remove the sea component of the sea-island type composite fiber included in the composite yarn, the yarn was reduced by 20% (alkaline reduction) in a 2.0% NaOH aqueous solution at 70° C. Thereafter, the yarn was dyed beige by a conventional dyeing process.

Thereafter, an aqueous solution containing PVA (molecular weight: 500) 5% sol and polyacrylic acid ester 1% sol as the binder (sizing agent) was prepared. While unreeling the yarn, the yarn was continuously immersed in the aqueous binder solution and wound while drying at a temperature of 80° C. to obtain a twisted yarn composed of two strands of the composite yarn.

In the obtained twisted yarn, the filament A-1 having a single-fiber diameter of 700 nm was arranged in the sheath part and the polyethylene terephthalate multi-filament (fiber A-2) having a single-fiber diameter of 10.5 μm and an apparent crimp rate of 7.8% was arranged in the core part. The total fineness of the yarn was 162 dtex and the application amount of the binder (sizing agent) was 9.0 wt %.

The obtained twisted yarn (yarn A) and a covering yarn FTY70T/2 (yarn B) in which a polyurethane fiber was arranged in the core part and a nylon fiber was arranged in the sheath part were twisted with a twisting machine at a twisting number S of 350 turns/m and untwisting prevention was performed at a temperature of 70° C. Socks were knitted using a 3.5 inch circular knitting machine using the obtained twisted yarn as the heel, sole, and toe portion as a pile knit, and using a blended yarn of polyester and cotton and a nylon yarn as the remainder of the sock.

Yarn A and yarn B were stably knit due to the elasticity thereof and no yarn breakage due to nap, etc., occurred. The yarn was excellent in handleability. The obtained circular knitted fabric was soaped with an aqueous solution containing 4% sol of soda ash and 2% sol of surfactant at 60° C., whereby the binder (sizing agent) was completely removed and the filament A-1 having a single-fiber diameter of 700 nm was exposed on both sides of the fabric. The fabric was very non-slippery. The coefficient of friction thereof was 0.6.

Example 5

Two strands of a sea-island type composite fiber obtained in the same manner as Example 4 and one strand of a side-by-side composite fiber multi-filament (total fineness 56 dtex/36 fil; single-fiber diameter: 12 μm; fiber A-2) in which polytrimethylene terephthalate and polyethylene terephthalate were bonded in a side-by-side manner to form a single fiber were interlaced to obtain a composite filament yarn.

Next, in order to remove the sea component of the sea-island type composite fiber included in the composite filament yarn, the yarn was reduced by 20% (alkaline reduction) in a 2.0% NaOH aqueous solution at 70° C. Thereafter, the yarn was dyed beige by a conventional dyeing process.

Thereafter, an aqueous solution containing PVA (molecular weight: 500) 5% sol and polyacrylic acid ester 1% sol as a binder (sizing agent) was prepared. While unreeling the yarn, the yarn was continuously immersed in the aqueous binder solution and wound while drying at a temperature of 80° C. to obtain a composite yarn (yarn A).

The obtained composite yarn (yarn A) was composed of the filament A-1 having a single-fiber diameter of 700 nm and the side-by-side multi-filament (fiber A-2) having a single-fiber diameter of 12 μm and an apparent crimp rate of 5.2%. The total fineness of the composite yarn was 157 dtex and the application amount of the binder (sizing agent) was 7.0 wt %.

The obtained twisted yarn (yarn A) and a covering yarn FTY70T/2 (yarn B) in which a polyurethane fiber is arranged in the core part and a nylon fiber is arranged in the sheath part were twisted with a twisting machine at a twisting number S of 350 turns/m and untwisting prevention was performed at a temperature of 70° C. Socks were knitted using a 3.5 inch circular knitting machine using the obtained twisted yarn as the heel, sole, and toe portion as a pile knit, and using a blended yarn of polyester and cotton and a nylon yarn as the remainder of the sock.

Yarn A and yarn B were stably knit due to the elasticity thereof and no yarn breakage due to nap, etc., occurred. The yarn was excellent in handleability. The obtained circular knitted fabric was soaped with an aqueous solution containing 4% sol of soda ash and sol of surfactant at 60° C., whereby the binder (sizing agent) was completely removed and the filament A-1 having a single-fiber diameter of 700 nm was exposed on both sides of the fabric. The fabric was very non-slippery. The coefficient of friction thereof was 0.65.

Example 6

Example 6 was produced in the same manner as Example 4 except that three strands of a composite yarn (yarn A) obtained in the same manner as Example 4 were twisted.

Thereafter, yarn A and yarn B were stably knit due to the elasticity thereof and no yarn breakage due to nap, etc., occurred. The yarn was excellent in handleability. The obtained circular knitted fabric was soaped with an aqueous solution containing 4% sol of soda ash and 2% sol of surfactant at 60° C., whereby the binder (sizing agent) was completely removed and the filament A-1 having a single-fiber diameter of 700 nm was exposed on both sides of the fabric. The fabric was very slippery. The coefficient of friction thereof was 0.55.

Example 7

Example 7 was produced in the same manner as Example 5 except that three strands of a composite yarn (yarn A) obtained in the same manner as Example 5 were twisted.

Thereafter, yarn A and yarn B were stably knit due to the elasticity thereof and no yarn breakage due to nap, etc., occurred. The yarn was excellent in handleability. The obtained circular knitted fabric was soaped with an aqueous solution containing 4% sol of soda ash and 2% sol of surfactant at 60° C., whereby the binder (sizing agent) was completely removed and the filament A-1 having a single-fiber diameter of 700 nm was exposed on both sides of the fabric. The fabric was very slippery. The coefficient of friction thereof was 0.6.

Example 8

A yarn having a binder (sizing agent) imparted thereto was obtained in the same manner as Example 1 except that a polyethylene terephthalate multi-filament having a total fineness of 56 dtex/36 fil was used instead of the multi-filament made of a side-by-side composite fiber of Example 1.

In the obtained yarn, the polyethylene terephthalate multi-filament had an apparent crimp rate of 0%. A circular knitted fabric was knitted using the obtained yarn with a circular knitting machine. Such a circular knitted fabric was inferior in handleability of the yarn due to frequent yarn breakage as a result of poor elasticity. Furthermore, the obtained circular knitted fabric was of low quality. The coefficient of friction thereof was a low value of 0.34.

Example 9

Example 9 was produced in the same manner as example 4 except that a polyethylene terephthalate multi-filament having a total fineness of 167 dtex/48 fil was used as yarn B in place of the covering yarn FTY70T/2 in which a polyurethane fiber is arranged in the core part and a nylon fiber was arranged in the sheath part.

Since yarn B had a low elasticity, yarn breakage occurred frequently during knitting and knitting could not be stably performed, whereby socks could not be obtained. The coefficient of friction was a low value of 0.3.

INDUSTRIAL APPLICABILITY

The present invention provides a yarn including an ultrafine filament, which has superior handling properties and with which a fabric and fiber product of a high quality can be obtained, a fabric using this yarn, and a fiber product using this yarn or fabric. The industrial value thereof is extremely high.

The invention claimed is:

1. A yarn comprising a filament A-1 having a single fiber diameter of 10 to 3000 nm and a fiber A-2 having a single fiber diameter greater than the filament A-1, wherein a binder is imparted to the yarn, wherein the fiber A-2 comprises a side-by-side composite fiber multi-filament, the single fiber of which being composed of polytrimethylene terephthalate as one component and polyethylene terephthalate as the other component, and wherein the fiber A-2 is a crimped fiber having a single-fiber diameter of not less than 5 μm and an apparent crimp rate of 5.2 to 40%.

2. The yarn according to claim 1, wherein the binder comprises a sizing agent and/or an oiling agent.

3. The yarn according to claim 1, wherein the application amount of the binder is 0.1 to 15 wt % with respect to the weight of the yarn.

4. The yarn according to claim 1, wherein the number of filaments of the filament A-1 included in the yarn is not less than 500.

5. The yarn according to claim 1, wherein the filament A-1 is obtained from a sea-island type composite fiber composed of a sea component and an island component by dissolving and removing the sea component.

6. The yarn according to claim 1, wherein after combining a sea-island type composite fiber composed of a sea component and an island component with the fiber A-2, the filament A-1 is obtained by dissolving and removing the sea component of the sea-island type composite fiber.

7. The yarn according to claim 1, wherein the filament A-1 is made of polyester fibers.

8. The yarn according to claim 1, wherein the total fineness of the yarn is in the range of 50 to 1400 dtex.

9. The yarn according to claim 1, wherein the yarn is dyed.

10. A fabric obtained using the yarn according to claim 1.

11. The fabric according to claim 10, further comprising a yarn B including an elastic fiber.

12. The fabric according to claim 11 wherein the weight ratio (A-1+A-2):B of the total weight of filament A-1 and the fiber A-2 to the yarn B is in the range from 95:5 to 30:70.

13. The fabric according to claim 11, wherein the coefficient of friction of a front surface or back surface of the fabric is in the range of 0.4 to 2.5.

14. A fiber product selected from the group consisting of socks, gloves, supporters, clothing, textile tape, and string obtained using the yarn according to claim 1.

15. The yarn according to claim 2, wherein the application amount of the binder is 0.1 to 15 wt % with respect to the weight of the yarn.

* * * * *